US012753590B1

(12) United States Patent
Williams

(10) Patent No.: US 12,753,590 B1
(45) Date of Patent: Oct. 6, 2026

(54) WATER LINE CONNECTION SYSTEM WITH A HOSE ATTACHMENT AND METHOD OF INSTALLATION

(71) Applicant: Donald Williams, Thornhill (CA)

(72) Inventor: Donald Williams, Thornhill (CA)

( * ) Notice: Subject to any disclaimer, the term of this patent is extended or adjusted under 35 U.S.C. 154(b) by 0 days.

(21) Appl. No.: 19/235,361

(22) Filed: Jun. 11, 2025

(51) Int. Cl.
*E03C 1/04* (2006.01)
*E03C 1/02* (2006.01)

(52) U.S. Cl.
CPC ..... *E03C 1/0403* (2013.01); *E03C 2001/026* (2013.01)

(58) Field of Classification Search
CPC ..... E03C 1/0403; E03C 2001/026
See application file for complete search history.

(56) References Cited

U.S. PATENT DOCUMENTS 4,429,931 A * 2/1984 Brooks ..... A62C 35/20 312/228
4,557,289 A 12/1985 Kasnik
5,630,628 A * 5/1997 M onch ..... F16L 37/0885 285/305
6,341,617 B1 * 1/2002 Wilson ..... E03C 1/04 137/359
6,434,765 B1 * 8/2002 Burns ..... E03C 1/0402 137/359

FOREIGN PATENT DOCUMENTS

| | | | |
|---|---|---|---|
| CA | 2216070 | A1 | 5/1999 |
| CN | 2661240 | Y | 12/2004 |
| EP | 0038421 | A1 | 10/1981 |
| EP | 2722076 | A1 | 4/2014 |
| WO | 2004082769 | A1 | 9/2004 |

* cited by examiner

*Primary Examiner* — Eric Keasel

(57) ABSTRACT

The present invention relates to a water line connection system with a hose attachment and method of installation comprising a tee joint inserted into an incoming cold-water pipe, a section of pipe connected to the tee joint, a shut-off valve attached to the pipe, a flexible branch line attached between the shut-off valve and a quick-connect coupling affixed to a coupling housing. An adaptor fitting is inserted into a hole in a countertop and the coupling housing is secured to the adaptor fitting such that the quick-connect coupling is accessible through the adaptor fitting. A hose may be attached to the quick-connect coupling and a nozzle may be attached at the end of the hose. A washer and nut may be used to secure the adaptor fitting to the countertop, and one or more pairs of goggles, and one or more safety face masks may be provided.

12 Claims, 7 Drawing Sheets

WATER LINE CONNECTION SYSTEM WITH A HOSE ATTACHMENT AND METHOD OF INSTALLATION

FIELD OF THE INVENTION

The present invention relates to the field of fire protection and more specifically to a system having a hose attachment for connecting to an existing waterline and method of installation of the system for permitting the rapid extinguishing of an apartment or condominium fire.

BACKGROUND OF THE INVENTION

All fires are life-threatening as they can produce toxic fumes which can overwhelm people very quickly, possibly resulting in their death. Within a few minutes a fire can increase rapidly such that it can only be extinguished by professionally trained firefighting crews.

Fire extinguishers are useful for extinguishing small fires and kitchen grease fires, but due to their limited size, they are minimally effective if a structure has become fully engulfed in flames. It is also likely that, when it becomes necessary, the occupant of a dwelling on fire (under very stressful conditions) may not remember how to operate the extinguisher. Of greater concern is the fact that even if the user is able to locate and use the extinguisher, they may not be able to either see or breathe properly due to the presence of thick, toxic smoke.

Most apartment and condominium buildings have fire-hose stations on each floor, but they cannot be used by the occupants as they are not trained in the use of heavy-duty firefighting equipment. By the time it takes an authorized person in the building or fire crews to respond to an alarm and then initialize a fire-hose station, at least five to ten minutes could have elapsed, and the initial fire could spread, therefore access time is critical.

For an occupant of an apartment or condominium to successfully combat a fire in their own unit a constant source of water is needed.

PRIOR ART

Other firefighting devices are known. For example, PCT/ES2004/000052 teaches a device that enables running water from any tap in a dwelling to be used as an extinguishing agent. The device receives taps of any size and is affixed to a tap for use. The device either must be applied to a tap in the event of a fire which would take too much time to do, or must always be attached to a tap so it is easily accessible in the event of a fire, which is not practical and is cumbersome on a home faucet.

European patent application EP 2 722 076 A1 teaches a fire hose that can be integrated into a domestic water supply. This is done by connecting the open end of a fluid conduit to a suitable point in the piping network of the building's water supply. A valve is attached either to the conduit or to a pipe and the valve can be activated when the fire hose is needed for use. This device requires that the hose be stored in a housing, through which the fluid conduit is attached. This configuration requires that the hose be removed from the housing before use and also requires a complicated set up that will take up space in a user's home. It is also difficult and expensive to hook up to through a wall.

CN2661240 Y teaches a fire hydrant for indoor use in which tap water is supplied to water guns in fluid communication with a hose. A water supply valve controls the on-off water path, and when the water supply valve is opened the water passage is turned on, and the valve is rotated back after being used to turn the water passage off. The fire hydrant is bulky and takes up a lot of space in a room and is difficult to store away when not in use.

Others have contemplated the use of equipment to extinguish an apartment or condominium fire. For example, European patent number EP0038421 discloses a coiled-up hose mounted in a box. This design is impractical in use because the coiled hose will expand and fall out of the box and become tangled when the water supply is activated. It also uses a complicated attachment which would take a long time to apply in a fire event.

Canadian Patent No. 2,216,070 discloses an arrangement whereby a box is mounted in a wall between studs. This application would be expensive to install, and as with EP0038421, the hose would fall out of the box and become tangled when activated.

U.S. Pat. No. 4,557,289 discloses another coiled hose design with a complicated and expensive attachment, which would take too long to attach in the event of a fire and is also prone to falling out of its container and getting tangled when in use.

Many other published patent applications and issued patents exist in the field of fire protection. However, they generally have complicated attachments that are expensive to manufacture and difficult to use in the event of a fire emergency.

What is needed is a simple and effective design that is low in cost, easy to install, enables fast connection and is easy to use by an untrained individual in the event of a fire.

SUMMARY OF THE INVENTION

In an embodiment of the present invention there is a water line connection system with a spray hose attachment, comprising the component parts of a tee joint to be inserted into an incoming cold-water pipe, a section of pipe to be added to a free end of the tee joint, a shut-off valve to be attached to a free end of the pipe, a flexible branch line and a coupling housing, wherein the flexible branch line is to be attached between the shut-off valve and the coupling housing, and wherein a quick-connect coupling is affixed to the coupling housing, and an adaptor fitting to be inserted into a hole in a countertop, wherein the coupling housing is secured to the adaptor fitting such that the quick-connect coupling is accessible through the adaptor fitting. In an embodiment of the present invention, the section of pipe is made of copper.

The water line connection system with a spray hose attachment may further comprise a coiled hose or a coiled hose having a nozzle for attachment to the quick-connect coupling, and in an embodiment of the invention, the hose is 50 feet long. The system may also comprise a washer and a nut for securing the adaptor fitting to the countertop.

The water line connection system with a spray hose attachment may further comprise one or more pairs of goggles, and one or more safety face masks.

In a further embodiment of the present invention there is a method of installing a water line connection system with a spray hose attachment, comprising the steps of inserting a tee joint into an incoming cold-water pipe, adding a section of pipe to a free end of the tee joint, attaching a shut-off valve to a free end of the pipe, attaching a flexible branch line to the shut-off valve, attaching a coupling housing affixed to a quick-connect coupling to a free end of the flexible branch line, creating a hole in a countertop to receive an adaptor fitting, inserting the adaptor fitting into the hole in the countertop, securing the coupling housing to the adaptor fitting such that the quick-connect coupling is accessible through the adaptor fitting.

The method may also comprise the steps of securing the adaptor fitting to the countertop, attaching a hose (that may be 50 feet long) to the quick-connect coupling, and attaching a nozzle to an end of the hose.

BRIEF DESCRIPTION OF DRAWINGS

These and other aspects of the present invention will be apparent from the brief description of the drawings and the following detailed description in which.

DETAILED DESCRIPTION OF THE INVENTION

In an embodiment of the present invention there is provided a water line connection system with a hose attachment that is relatively simple to install and operate and permits the rapid extinguishing of an apartment or condo fire by an untrained occupant.

Figure 1B:
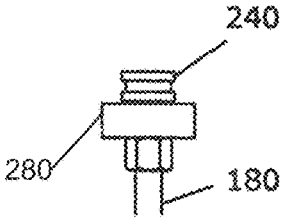
FIG. 1*b* is a side view of a coupling housing with a female quick-connect coupling of the present invention.
Figure 1C:
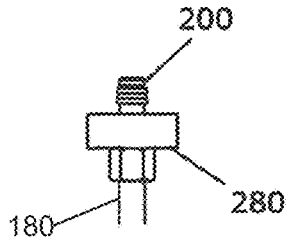
FIG. 1*c* is a side view of a coupling housing with a male quick-connect coupling of the present invention.
Figure 1A:
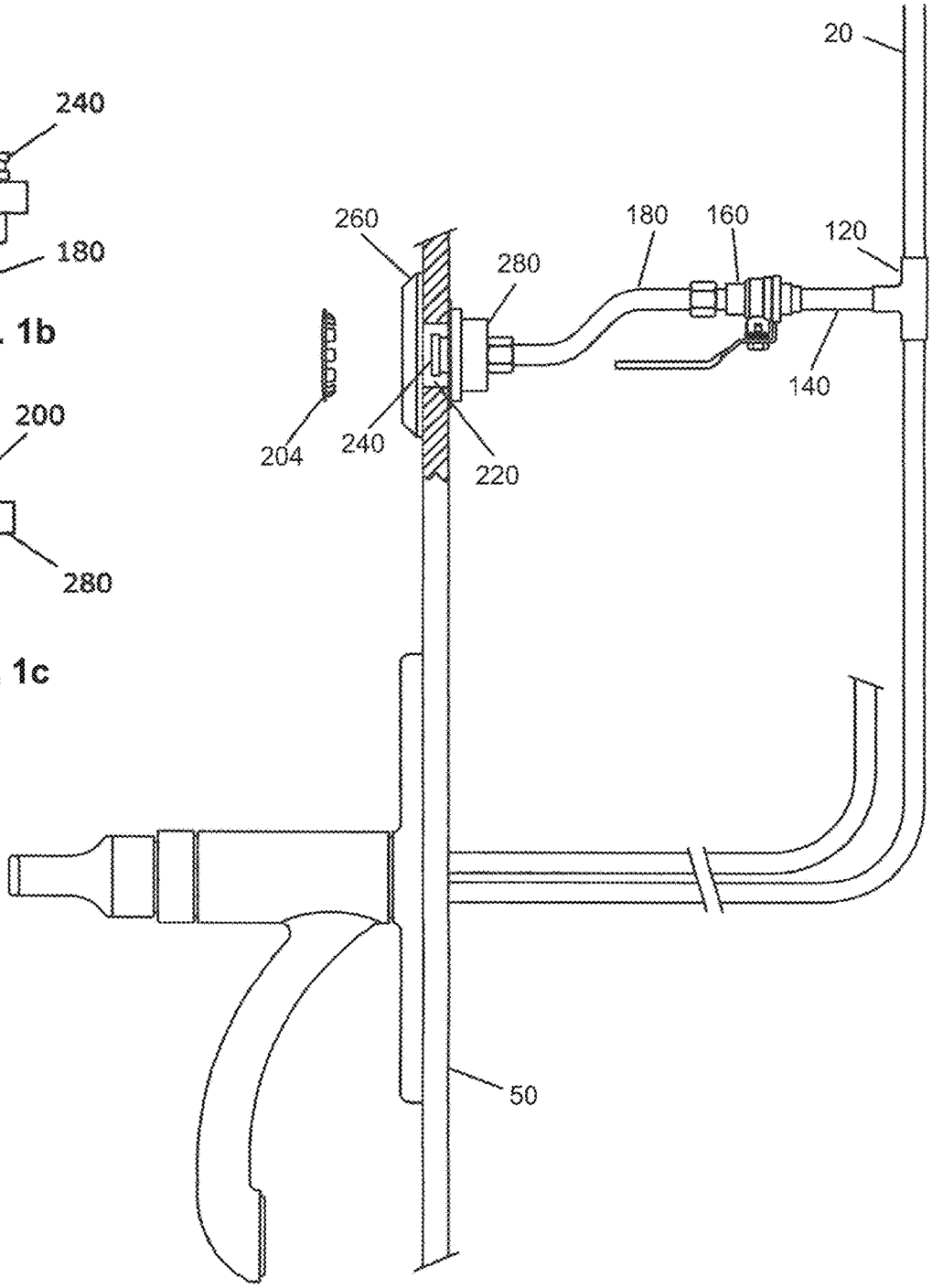
FIG. 1*a* is a side partial cut away view of an installed water line connection system of the present invention in a storage position.

As is seen in the embodiment shown in FIG. 1*a* in which the system has been installed and is in a storage position, the system comprises components that are connected to an existing cold water inlet pipe 20 that typically exists under a kitchen or bathroom sink 40. In an embodiment of the present invention, the system comprises a tee joint 120, a section of water pipe section 140, a shut-off valve 160, a flexible branch line 180, an adaptor fitting 260, and at least one coupling housing 280 having a male quick-connect coupling 200 or a female quick-connect coupling 240. In a further embodiment of the present invention, the system also comprises a snap-in cap 204.

Figure 2:
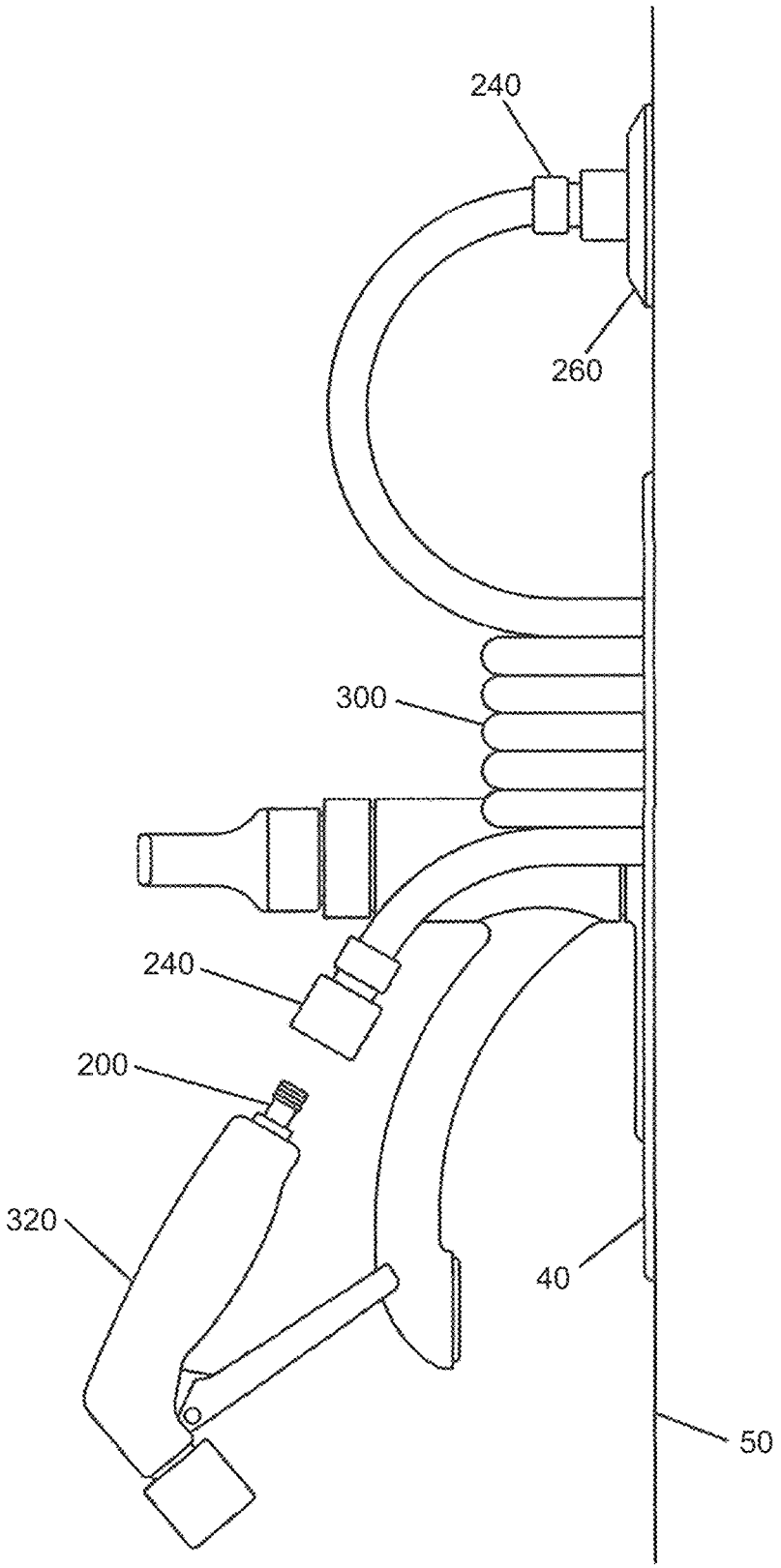
FIG. 2 is a side view of an installed water line connection system of the present invention above a countertop in a use position.
Figure 6:
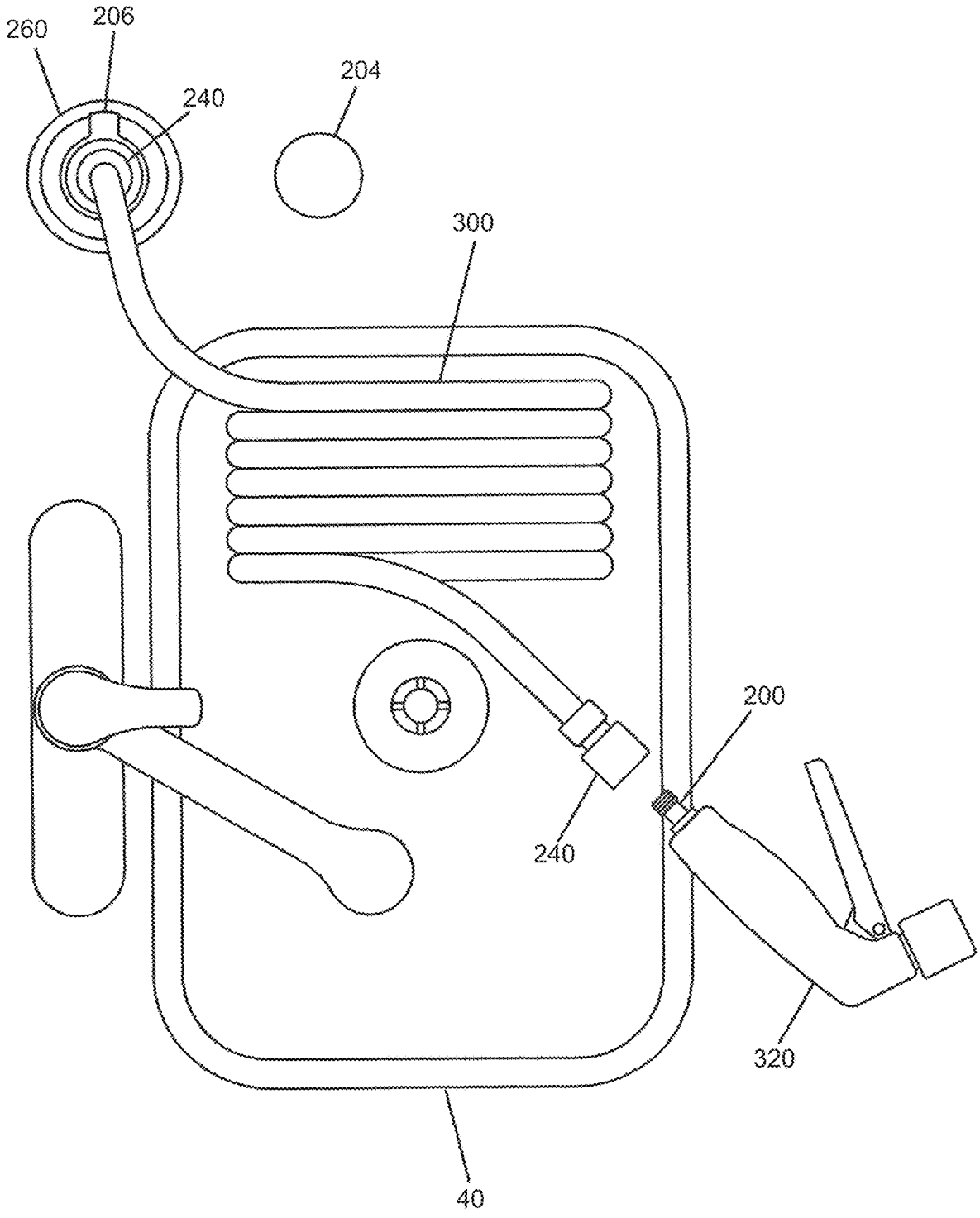
FIG. 6 is a top view of FIG. 2.

As is seen in the embodiment shown in FIG. 2 and FIG. 6 in which the system has been installed and is in a use position, the system also comprises a coiled hose 300 having a male quick-connect coupling 200 or a female quick-connect coupling 240 at each end, and a nozzle 320 having either a male quick-connect couplings 200 or a female quick-connect couplings 240 at an end of the nozzle 320 for attachment to the coiled hose 300. The male quick-connect coupling 200 or a female quick-connect coupling 240 at either end of the coiled hose 300 are used to connect the coiled hose 300 to the male quick-connect coupling 200 or female quick-connect coupling 240 that is accessed through the adaptor fitting 260. In an embodiment, the coiled hose 300 is fifty feet in length. Safety goggles (not shown) and one or more safety face masks (not shown) may also be provided in an embodiment of the system.

The quick connect couplings 200, 240 are joints where the female quick-connect coupling has a spring-loaded locking collar (not shown) but which are known in the art. The spring-loaded locking collar is pulled back under spring-tension and the male quick-connect coupling is then inserted. As the male quick-connect coupling is inserted, it passes through an O-ring seal and when fully-seated, the spring-loaded locking collar of the female quick-connect coupling is retracted, and the joint is locked so that it cannot come apart. To unlock the joint and separate the male and female quick-connect couplings, the spring-loaded locking collar of the female quick-connect coupling is again pulled back and the male quick-connect coupling is easily removed by pulling it away from the female quick-connect coupling. This process occurs in a few seconds permitting the fast attachment of the parts of the system of the present invention.

As shown in FIGS. 4, 5*a*, 5*b*, and 5*c*, the adaptor fitting 260 has an adaptor fitting top 380 and a threaded bottom adaptor collar 400. The adaptor fitting top 380 comprises a top adaptor opening 440 and a bottom opening 420. The top adaptor opening 440 includes an adaptor access hole 202 that receives a snap-in cap 204 to cover the top adaptor opening 440 when not in use, and a snap-in cap removal recess 206 to help remove the snap-in cap prior to use.

The adaptor fitting top 380 may have a beveled edge that is both aesthetically pleasing and is for safety purposes as it prevents the adaptor fitting top 380 from having a sharp edge.

Figure 5A:
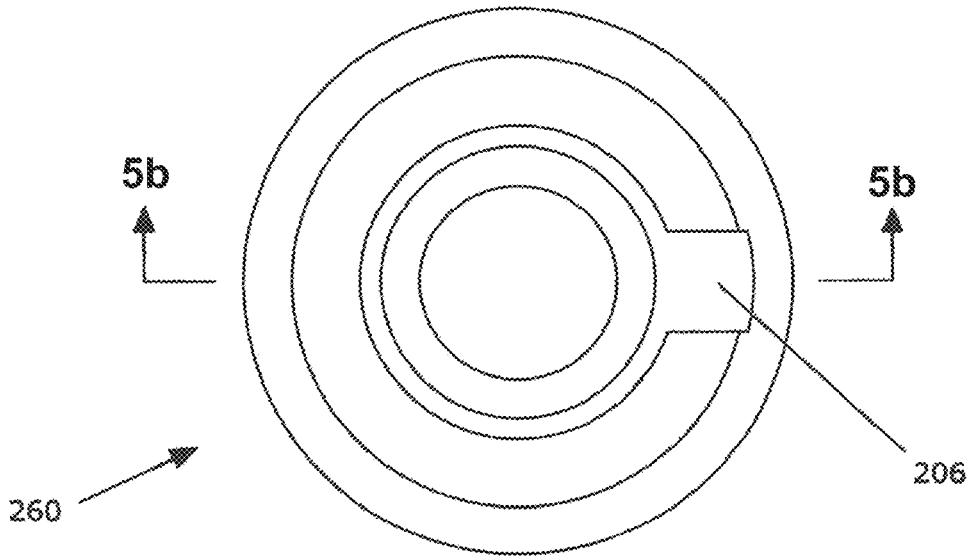
FIG. 5*a* is a top view of the adaptor fitting of FIG. 3*a*.
Figure 5B:
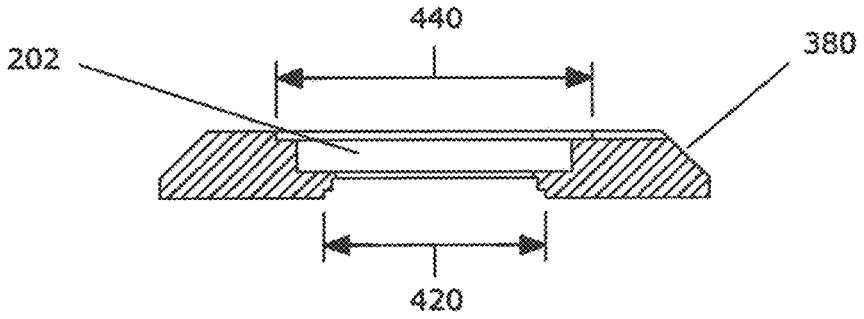
FIG. 5*b* is a cross-sectional side view of the adaptor fitting top of the adaptor fitting of FIG. 4.
Figure 5C:
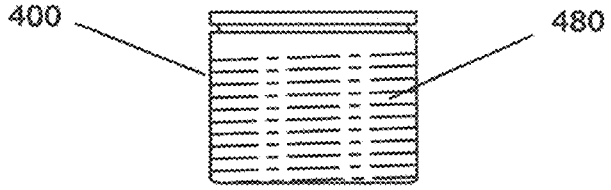
FIG. 5*c* is a side view of the adaptor fitting collar of the adaptor fitting of FIG. 4.

It is understood that while the adaptor fitting top 380 and bottom adaptor collar 400 are shown separate in FIG. 5*c*, it is nevertheless understood that this is for illustrative purposes only and the adaptor fitting top 380 and bottom adaptor collar 400 are a single piece. In an embodiment of the present invention where the adaptor fitting 260 is made of brass, the adaptor fitting top 380 and the bottom adaptor collar 400 may be brazed together.

As shown in FIGS. 1*a*, 1*b*, and 1*c*, the coupling housing 280 has a threaded interior and male quick-connect coupling 200 shown in FIG. 1*b* or female quick-connect coupling 240 shown in FIG. 1*c* is mounted within the coupling housing 280. In an embodiment of the present invention where the coupling housing 280 and the quick-connect couplings 200, 240 are made of brass, the coupling housing 280 and a quick-connect coupling, either 200 or 240, are brazed together, making them a permanent assembly.

The snap-in cap 204 comprises a snap-in cap top 208 from which extends snap-in cap prongs 210. The snap-in cap top 208 rests in the top adaptor opening 440 and the snap-in cap prongs 210 snap into the adaptor access hole 202. When the snap-in cap 204 is removed from the adaptor fitting 260, a female quick-connect coupling 240 at an end of a coiled hose 300 can be connected to the male coupling 200 (which acts as a hose attachment) that is mounted withing the coupling housing 280 which in turn is attached to the bottom adaptor collar 400 of the adaptor fitting 260.

In an embodiment of the present invention, the adaptor fitting 260 top and snap-in cap 204 are made of brass and may be nickel plated for aesthetic purposes. It is understood that the snap-in cap, adaptor fitting, coupling housing, and quick-connect couplings could be made out of a variety of materials, and while this description specifically contemplates brass, materials including aluminum, steel or plastic could also be used.

In an embodiment of the present invention in which the system is installed in a countertop 50 in a mounting hole 220 that is drilled through a countertop close to the faucet (or an existing hole in a countertop), such as a kitchen countertop or a bathroom vanity countertop. An adaptor fitting 260 is placed into the mounting hole 220 such that the adaptor fitting top 380 rests on the countertop 50 and the bottom adaptor collar 400 extends through the hole. It is understood that the mounting hole 220 installed in the countertop 50 will be slightly larger than the bottom adaptor collar 400, but smaller than the adaptor fitting top 380.

Figure 3A:
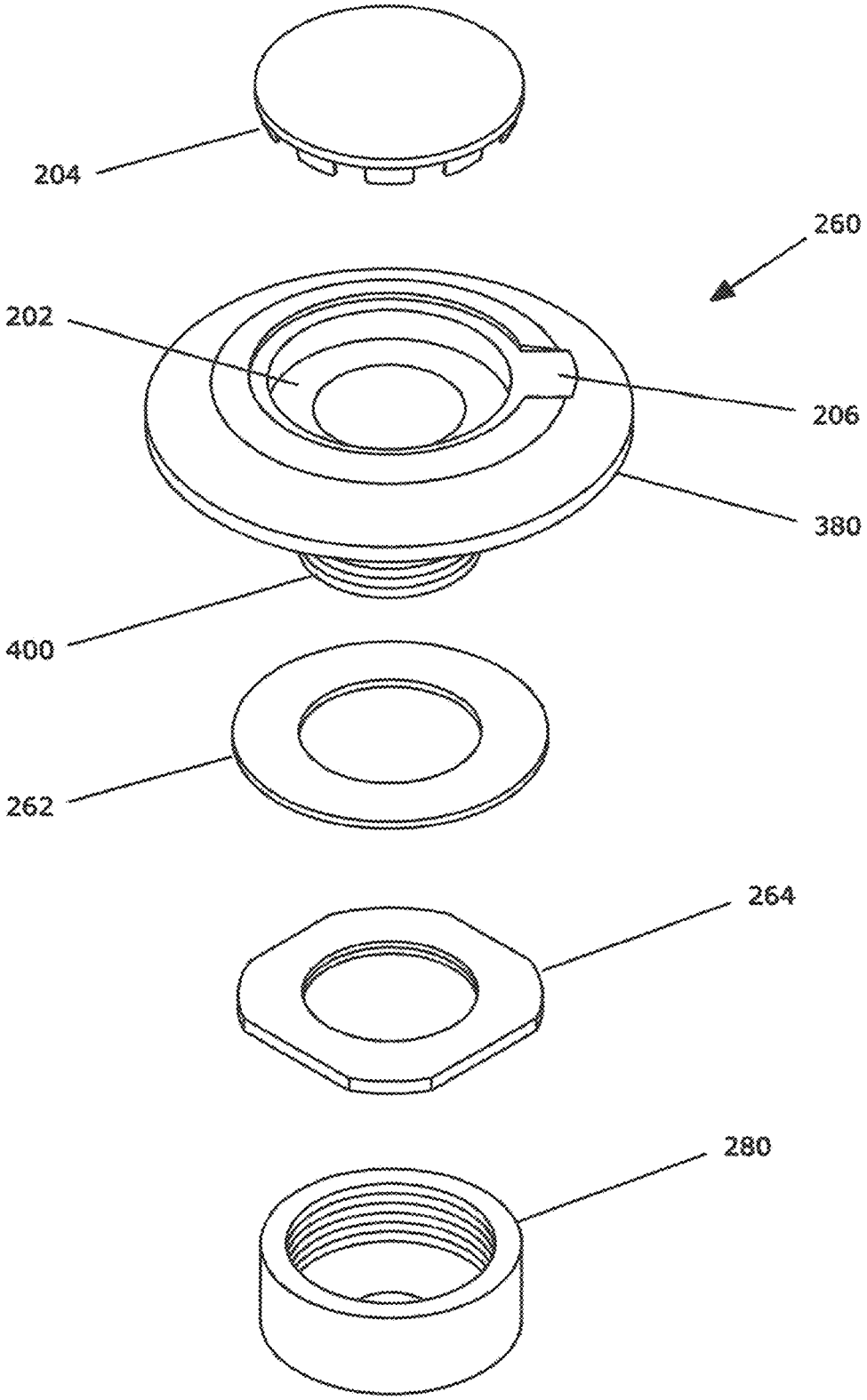
FIG. 3*a* is an exploded perspective view of an adaptor fitting and coupling housing of the present invention with a snap-in cap.
Figure 3B:
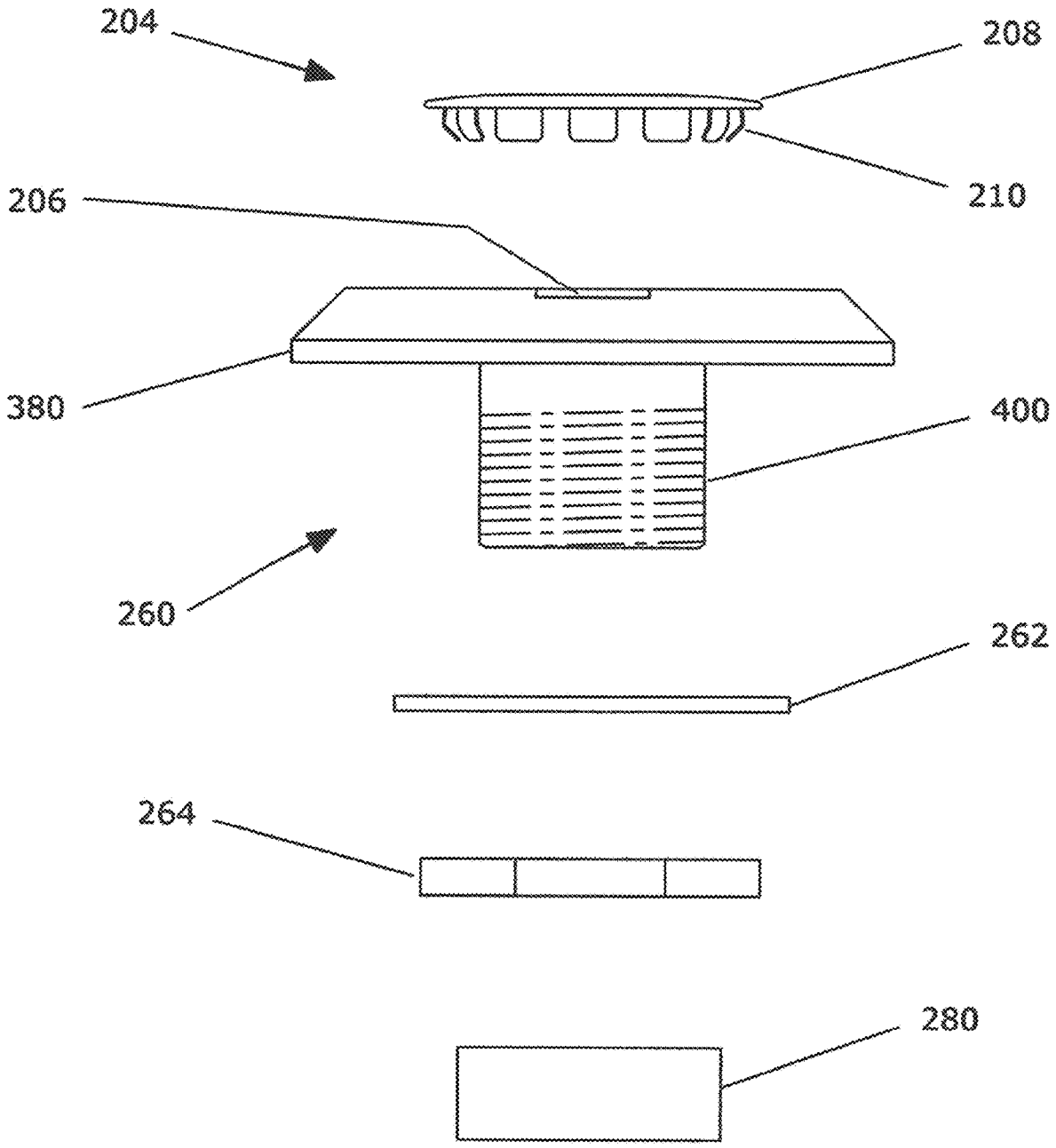
FIG. 3*b* is an exploded side view of FIG. 3*a*.
Figure 4:
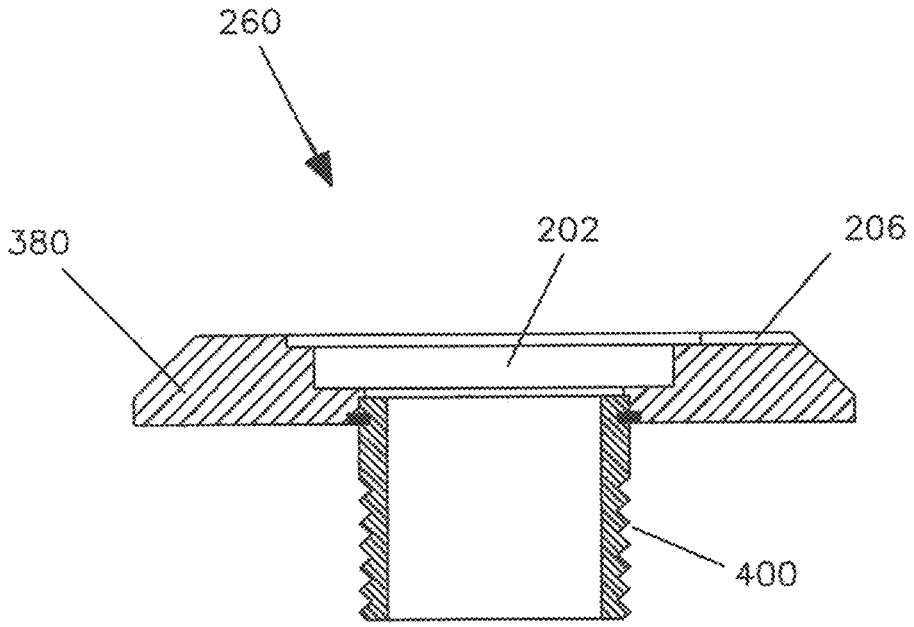
FIG. 4 is a cross-sectional view of the adaptor fitting of FIG. 3*a*.

The bottom adaptor collar 400 is threaded to accept the nut 264, as shown in FIG. 3*a* and FIG. 3*b*. When the adaptor fitting 260 is inserted into the mounting hole 220 in the countertop 50, the threading 480 on the bottom adaptor collar 400 protrudes below the countertop 50 and the washer 262 and nut 264 are screwed onto the bottom adaptor collar, to secure the adaptor fitting 260 in place.

Once the adaptor fitting 260 has been secured to a countertop 50, the coupling housing 280 having a threaded interior (shown in these FIGS. without a quick-connect coupling) secured to the adaptor fitting 260 by screwing it onto the threaded bottom adaptor collar 400 that extends beneath the countertop 50; see FIGS. 3*a* and 3*b*. The male quick-connect coupling 200 (not shown) is then accessible for connection within the adaptor fitting 260 when the snap-in cap 204 is removed. This male quick-connect coupling 200 (or female quick-connection coupling 240) accessible through the adaptor access hole 202 of the adaptor fitting 260 creates a hose attachment for the rapid attachment of a coiled hose 300.

For illustrating the invention in this description, a male quick-connect coupling 200 is used. It is nonetheless understood that the male quick-connect coupling 200 and female quick-connect coupling 240 are interchangeable throughout the present application if a male quick-connect coupling 200 is paired with a female quick-connect coupling 240 for the purpose of joining the parts of the system. Similarly, the male quick-connect coupling 200 and female quick-connect coupling 240 are interchangeable throughout the present application.

In an embodiment of the present invention relating to the method of installation of the system described above, the incoming cold-water pipe 20 is shut-off at its stop valve. A section of the existing incoming cold-water pipe 20 that is approximately 1.5 inches long near the faucet is removed and a tee joint 120 is inserted into the incoming cold-water pipe 20. A section of water pipe section 140 is added to the free end of the tee joint 120. A shut-off valve 160 is attached to the free end of the water pipe section 140 and a coupling housing 280 having a male or female coupling is attached to the shut-off valve 160. In a preferred embodiment of the present invention, this male or female coupling is either a male or female quick-connect coupling 200, 240. In an embodiment of the present invention, a quarter-turn shut-off valve may be used.

The flexible branch line 180 is attached between the shut-off valve 160 and the quick-connect coupling 200 or 240 attached to the coupling housing 280 that is secured to the adaptor fitting 260.

The present invention makes it simple and fast to connect the coiled hose 300 and nozzle 320 to the water line connection system. The design of adaptor fitting 260 allows for easy and inexpensive connection to the existing water supply. It does not require cutting through walls or drilling holes through concrete or plaster to connect the adaptor fitting 260 to the countertop 50. The adaptor fitting 260 of the present invention allows for a user to install it through one hole in a countertop 50, such as a kitchen countertop or a vanity countertop, and the rest of the components of the system can be readily purchased from a number of sources.

It is understood that copper piping or other varieties of pipe/tubing can be used. For example, plastic tubing, couplings and valves. These other materials may be connected to other components in the system by means of gluing, compression coupling, press-fitting or screwing the parts together.

In an embodiment of the present invention, the one or more face masks, such as an N95 or similar mask, and safety goggles may be stored nearby and are provided in at least two locations, since a fire could occur at either end of an apartment or condominium. One set would be located near the kitchen sink and the other in the bedroom, close to the bed. These two items must be immediately accessible if a fire breaks out at either end of the apartment or condominium unit.

In an embodiment of the present invention, the coiled hose 300 could be hung on a simple bracket, which could be installed under a kitchen counter or bathroom vanity. In a preferred embodiment of the present invention, the coiled hose 300 is not encased in a separate container but is readily accessible in a minimal amount of time so that it can be quickly attached to the water source.

The coiled hose 300 with its attached nozzle 320 could be stored beneath the kitchen or bathroom counter or another location which would be close to the water source.

A 50 feet length of hose may be adequate for most apartments and condominiums but for much larger units, it would be necessary to acquire a hose of greater length. Alternatively, a second system could be installed at a second location in the apartment or condominium.

When there is no fire in the apartment or condominium unit, the water supply is shut off by maintaining the shut-off valve 160 in a closed position.

In operation, if a fire breaks out, the occupant could first put on the mask and goggles. They would then remove the snap-in cap 204 from the adaptor fitting 260 by pulling it up by reaching into the snap-in cap removal recess 206 to assist in its removal. It is understood that a knife or similar tool could be used to help remove the snap-in cap 204. The free end of the coiled hose 300 with a female quick-connect coupling 240 is then attached to the male quick-connect coupling 200 (which acts as a hose attachment) mounted in the coupling housing 280 that is secured to the adaptor fitting 260; see FIGS. 2 and 6. The shut-off valve 160 is then actuated to turn on the water supply.

As shown in FIG. 6, placing the coiled hose 300 in the sink 40 may assist it to uncoil smoothly and without kinking when it is pulled to the location of the fire. When the fire incident is over, the coiled hose 300 can easily be drained of water and re-form its coiled shape for storage and re-use. The system is now ready to be used to extinguish a fire.

In an embodiment of the present invention, quick-connect couplings that are well known are used so that very little time is wasted in connecting the coiled hose 300 and nozzle 320. While several methods of connection are available, the use of quick-connect couplings in the present invention are preferred because time is critically important in a fire event and quick-connect couplings can be connected in seconds.

This is a very simple procedure, and the occupant would be in a position to fight a fire in as little as one minute and would have a constant supply of water. The method of connecting the coiled hose 300 to the adaptor fitting 260 is not difficult and anyone could learn to do it very quickly.

The acrid smoke produced by burning materials would normally render the occupant unable to see and breathe properly and potentially cause severe damage to their lungs and eyes. By wearing goggles and a mask they would be protected and would be able to connect the components quickly, enabling them to fight the fire themselves and likely contain, reduce and possibly extinguish the fire prior to the arrival of an emergency crew.

In an embodiment of the present invention, there is provided a kit containing the components of the water line connection system of the present invention including the parts of a tee joint, a water pipe section, a shut-off valve, a branch line, a coupling housing with a coupling, and an adaptor fitting. In a further embodiment of the present invention there is also provided a coiled hose with a coupling, preferably with a nozzle also having a coupling.

If systems such as those described herein were made available in all high-rise buildings, they would be relatively inexpensive and could be easily absorbed into the cost of an apartment or condominium. They would hopefully never be used but would always be available in case of an emergency, just as fire extinguishers have been for many decades.

For existing apartment owners who would like to safeguard their homes, a complete system could be made available for sale at department stores and this system would include all the items in the system described herein.

The plumbing components and adaptor supplied with the systems could be easily installed by do-it-yourselfers or could be done by a professional plumber in a short time and at minimal cost. Regardless of that fact, the safety aspect of these items should far outweigh the dollar amount required to purchase and install them.

When mass-produced, these systems could be retailed for a relatively inexpensive price and would give a condominium or apartment dweller peace-of-mind knowing that they have a means of possibly saving their life should a fire occur.

While the primary function of this design is to control and extinguish an apartment or condominium fire, the system could also be used for applications such as watering plants that are situated on a balcony, spraying and cleaning the outside of the doors and windows, and spraying the balcony itself and the vertical panels to remove deposited grime or dirt.

The system of the present invention is also advantageous because it does not require a power supply or batteries to function and so there is no risk associated with the invention not working in a power outage or ensuring that batteries are being regularly replaced so that the invention works when it is needed.

While embodiments of the invention have been described in the detailed description, the scope of the claims should not be limited by the preferred embodiments set forth in the examples but should be given the broadest interpretation consistent with the description as a whole

The invention claimed is:

1. A water line connection system for connecting a hose to an existing waterline, the system comprising:

a tee joint to be inserted into an incoming cold-water inlet pipe;

a section of water pipe to be added to a free end of the tee joint;

a shut-off valve to be attached to a free end of the section of water pipe;

a flexible branch line and a coupling housing, wherein the flexible branch line is to be attached between the shut-off valve and the coupling housing, wherein a quick-connect coupling is affixed to the coupling housing; and an adaptor fitting to be inserted into a hole in a countertop, wherein the coupling housing is secured to the adaptor fitting such that the quick-connect coupling is accessible through the adaptor fitting for providing attachment to the hose.

2. The water line connection system of claim 1, wherein the section of the water pipe is made of copper.

3. The water line connection system of claim 1, wherein the hose is a coiled hose for attachment to the quick-connect coupling.

4. The water line connection system of claim 3 wherein the coiled hose for attachment to the quick-connect coupling is 50 feet long.

5. The water line connection system of claim 3, wherein the coiled hose comprises a nozzle.

6. The water line connection system of claim 1, further comprising a washer and a nut for securing the adaptor fitting to the countertop.

7. A method of installing a water line connection system with a hose attachment, comprising steps of:

inserting a tee joint into an incoming cold-water pipe;

adding a section of pipe to a free end of the tee joint;

attaching a shut-off valve to a free end of the pipe;

attaching a flexible branch line to a free end of the shut-off valve;

attaching a coupling housing affixed to a quick-connect coupling to a free end of the flexible branch line;

creating a hole in a countertop to receive an adaptor fitting;

inserting the adaptor fitting into the hole in the countertop;

securing the coupling housing to the adaptor fitting such that the quick-connect coupling is accessible through the adaptor fitting.

8. The method of claim 7, wherein the pipe is a copper pipe.

9. The method of claim 7, further comprising a step of inserting a washer and a nut between the adaptor fitting and an underside of the countertop.

10. The method of claim 7, further comprising a step of attaching a hose to the quick-connect coupling.

11. The method of claim 10, wherein the hose is 50 feet long.

12. The method of claim 10, wherein a nozzle is attached to an end of the hose.

* * * * *